US007665775B1

(12) United States Patent
Miller et al.

(10) Patent No.: US 7,665,775 B1
(45) Date of Patent: Feb. 23, 2010

(54) LOCKING WINDOW HAVING A CAM LATCH

(75) Inventors: D. Keith Miller, Trinity, NC (US); Christopher R. Rogers, Winston-Salem, NC (US); Farrell Smith, Sophia, NC (US); Jeffrey T. Hughes, Winston-Salem, NC (US)

(73) Assignee: Hughes Supply Company of Thomasville, Inc., Thomasville, NC (US)

( * ) Notice: Subject to any disclaimer, the term of this patent is extended or adjusted under 35 U.S.C. 154(b) by 829 days.

(21) Appl. No.: 10/634,118

(22) Filed: Aug. 4, 2003

Related U.S. Application Data

(63) Continuation of application No. 09/922,577, filed on Aug. 3, 2001, now abandoned.

(51) Int. Cl.
*E05C 3/02* (2006.01)
*E05C 3/00* (2006.01)

(52) U.S. Cl. ..... 292/240; 292/98; 292/DIG. 20; 292/DIG. 47

(58) Field of Classification Search ..... 292/111, 292/98, 240, DIG. 7, DIG. 20, DIG. 33, DIG. 47, 292/11, DIG. 38, DIG. 471; 70/89, 90
See application file for complete search history.

(56) References Cited

U.S. PATENT DOCUMENTS

| | | | | | |
|---|---|---|---|---|---|
| 907,535 | A | | 12/1908 | Raapson | |
| 2,151,219 | A | * | 3/1939 | Madsen | 292/111 |
| 2,873,134 | A | * | 2/1959 | Ahlgren | 292/111 |
| 2,997,323 | A | * | 8/1961 | Riser | 292/111 |
| 3,125,923 | A | | 3/1964 | Hanneman | 85/47 |
| 3,645,573 | A | | 2/1972 | Strang | 292/241 |
| 4,036,039 | A | | 7/1977 | Nakanishi | 70/90 |
| 4,061,370 | A | | 12/1977 | Hauber | 292/175 |
| 4,093,285 | A | | 6/1978 | Fayle | 292/251 |
| 4,095,829 | A | | 6/1978 | Van Klompenburg | 292/241 |
| 4,135,773 | A | | 1/1979 | Van Remoortel | 308/238 |
| D268,643 | S | | 4/1983 | Anderson | D8/337 |
| 4,405,161 | A | * | 9/1983 | Young et al. | 285/80 |
| 4,578,903 | A | | 4/1986 | Simpson | 49/175 |
| 4,621,847 | A | * | 11/1986 | Paulson et al. | 292/199 |
| 4,736,972 | A | | 4/1988 | Mosch | 292/204 |
| 4,763,497 | A | | 8/1988 | Nakai | 70/95 |
| 4,790,579 | A | | 12/1988 | Maxwell et al. | 292/175 |
| 4,801,164 | A | | 1/1989 | Mosch | 292/204 |
| 4,818,000 | A | | 4/1989 | Bobrowski | 292/147 |
| D302,651 | S | | 8/1989 | Mosch | D8/337 |
| 5,040,835 | A | | 8/1991 | Barker | 292/338 |
| 5,060,993 | A | | 10/1991 | Maier | 292/241 |
| 5,103,533 | A | | 4/1992 | Pettit et al. | 16/342 |

(Continued)

OTHER PUBLICATIONS

DuPont Engineering Polymers Product and Properties Guide; Copyright 2000.

(Continued)

*Primary Examiner*—Carlos Lugo
(74) *Attorney, Agent, or Firm*—MacCord Mason PLLC

(57) ABSTRACT

A locking window that is selectively movable between a first closed position and a second open position and a window latch adapted to be attached to the window is disclosed. The window latch includes a cam latch, a housing including a support wall, a pivot fastener for attaching the cam latch to the housing, and a detent for retaining the cam latch in one of the open and the locked positions.

44 Claims, 6 Drawing Sheets

U.S. PATENT DOCUMENTS

| | | | | | |
|---|---|---|---|---|---|
| 5,110,165 | A | * | 5/1992 | Piltingsrud | 292/242 |
| 5,161,839 | A | * | 11/1992 | Piltingsrud et al. | 292/241 |
| 5,219,193 | A | * | 6/1993 | Piltingsrud | 292/240 |
| 5,219,195 | A | | 6/1993 | Lawrence | 292/336.3 |
| 5,248,174 | A | | 9/1993 | Matz et al. | 292/338 |
| 5,301,989 | A | | 4/1994 | Dallmann et al. | 292/142 |
| 5,414,899 | A | | 5/1995 | Raetz | 16/380 |
| 5,454,609 | A | * | 10/1995 | Slocomb et al. | 292/337 |
| 5,489,131 | A | | 2/1996 | Blom | 292/101 |
| D369,741 | S | | 5/1996 | Harrison et al. | D8/400 |
| 5,582,445 | A | * | 12/1996 | Olsen et al. | 292/241 |
| 5,632,394 | A | * | 5/1997 | Mecca et al. | 220/824 |
| D380,957 | S | | 7/1997 | Evans et al. | D8/337 |
| D382,191 | S | | 8/1997 | Plummer | D8/337 |
| D386,384 | S | | 11/1997 | Rausch et al. | D8/330 |
| 5,741,032 | A | | 4/1998 | Chaput | 292/202 |
| 5,839,767 | A | | 11/1998 | Piltingsrud | 292/336.3 |
| D418,737 | S | | 1/2000 | Libby et al. | D8/337 |
| 6,010,094 | A | | 1/2000 | Caik et al. | 244/129.1 |
| 6,068,306 | A | * | 5/2000 | Brautigam | 292/242 |
| D432,392 | S | | 10/2000 | Miller et al. | D8/337 |
| 6,135,510 | A | * | 10/2000 | Diginosa | 292/145 |
| 6,142,541 | A | * | 11/2000 | Rotondi | 292/241 |
| 6,203,076 | B1 | * | 3/2001 | Wytcherley et al. | 292/202 |
| D442,058 | S | | 5/2001 | Miller et al. | D8/337 |
| 6,347,820 | B2 | | 2/2002 | Subliskey | 292/346 |
| 6,349,576 | B2 | * | 2/2002 | Subliskey | 70/90 |
| 6,412,834 | B1 | | 7/2002 | Waitai et al. | 292/197 |
| 6,457,752 | B1 | | 10/2002 | Miller et al. | 292/202 |
| 6,565,133 | B1 | * | 5/2003 | Timothy | 292/242 |
| 6,565,135 | B2 | * | 5/2003 | Wytcherley et al. | 292/336.3 |
| 6,568,723 | B2 | * | 5/2003 | Murphy et al. | 292/241 |
| 6,598,910 | B2 | * | 7/2003 | McGregor et al. | 292/156 |
| 6,634,683 | B1 | * | 10/2003 | Brannan | 292/241 |

OTHER PUBLICATIONS

Delrin Only By DuPont; Low Wear Low Friction; Undated—possible prior art.

Du Pont Delrin Acetal Resin Molding Guide; Undated—possible prior art.

DuPont Delrin Acetal Rresin Deisgn Guide-Module III; Undated—possible prior art.

Ultramid Polyamides Applications, Product range, Properties, Processing; Undated—possible prior art.

* cited by examiner

LOCKING WINDOW HAVING A CAM LATCH

This application is a continuation of application Ser. No. 09/922,577 filed Aug. 3, 2001, now abandoned.

BACKGROUND OF THE INVENTION (1) Field of the Invention

The present invention relates generally to a locking window and, more particularly, to a window latch for such a window.

(2) Description of the Prior Art

Up to the end of World War II, most windows were constructed of wood. However, following the War, aluminum windows were initially constructed for low-end housing. Over time, the clear superiority of metal windows led to their use in many different types of housing. Similarly, vinyl windows were introduced in low-end housing in the beginning of the last decade. The use of vinyl windows has grown much more quickly than metal windows. In fact, the majority of windows are now constructed of vinyl.

During this time, locking windows have generally used metal latches similar to those that were initially used on wooden windows. Now, although vinyl windows are the predominant construction, there has still been a hesitancy to use plastic hardware. However, metal is much heavier than its corresponding plastic counterpart. Also, plastic retains its appearance when mishandled or otherwise misused that would cause unacceptable chips to form on painted metal hardware. Also, in today's modern economy, window hardware may be made in another country. Accordingly, advantages of substantial weight savings and lower shipping costs have become even more important.

However, making a locking window having a plastic latch is more than a mere substitution of materials. Because plastic is generally more flexible than metal, attempts at constructing a window latch having a center mounted sweep latch have failed since there's not a sufficient amount of support across the center of the sweep to prevent bowing. The importance of bowing is primarily due to the requirement by most manufacturers that the cam latch be able to maintain a static load of about 160 pounds. When a conventional center mounted window latch is formed from plastic materials, the bowing of the cam latch is so substantial that the static load will actually slide off the locking arm. Because of this problem, such window latches have not been able to pass the static load test.

Thus, there remains a need for a new and improved locking window having a window latch which may be completely formed from chip resistant plastics while, at the same time, still provides sufficient strength due to its housing arrangement to resist normal wear and tear during assembly and use.

SUMMARY OF THE INVENTION

The present invention is directed to a locking window having a window frame including at least one window sash that is selectively movable between a first closed position and a second open position and a window latch adapted to be attached to the window. The window latch is selectively movable between a first open position and a second locked position to secure the window sash in the closed position. The window latch includes a cam latch, a housing including a support wall, a pivot fastener for attaching the cam latch to the housing, and a detent for retaining the cam latch in one of the open and the locked positions.

In a preferred embodiment, the detent provides an audible indication of the cam latch being in one of the open and the locked positions. This may be accomplished by one of several configurations. For example, the detent may include at least one protrusion on one of the housing and the cam latch and a receiving groove on the other of the housing and the cam latch. Preferably, the protrusion and the groove are substantially parallel to the axis of the pivot fastener.

Alternatively, the detent may include at least one protrusion on one of the housing and the cam latch and a semi-circular receiving groove on the other of the housing and the cam latch. Preferably, the semi-circular receiving groove includes at least one barbell shaped portion for receiving the protrusion. More preferably, the protrusion is substantially parallel to the axis of the pivot fastener and the groove is substantially perpendicular to the axis of the pivot fastener.

In a preferred alternative, the detent may further include a bushing adapted for use with the pivot fastener. In such an arrangement, the detent includes at least one protrusion on one of the housing and the bushing and a receiving groove on the other of the housing and the bushing. The receiving is grooved for receiving the protrusion. Preferably, the protrusion and the groove are substantially parallel to the axis of the pivot fastener. In an even more preferred aspect of the present embodiment, the detent may include at least one resilient portion on one of the housing and the bushing. The resilient portion accommodates the protrusion when the cam latch is moved from one of the open and the locked positions to the other of the open and the locked positions.

Those skilled in the art will appreciate that any of the above-described detent configurations may be used separately or in various combinations with each other and other detent configurations to accomplish the creation of the audible indication of the cam latch being in one of the open and the locked positions.

The cam latch may include an actuator arm, a locking arm and a pivot point location between the actuator arm and the locking arm. A finger tab may be included on the actuator arm. Further, the locking arm may include a cam wall. To provide a mechanical advantage when the window latch is operated, a ratio of a length of the actuator arm to a length of the locking arm is greater than about 2.

One of the actuator arm and the locking arm may include a key lock receptor and the other of the actuator arms and the locking arms then includes a complementary key lock extending into the key lock receptor for attaching the cam latch to the housing. A fastener may extend into the key lock and key lock receptor. Preferably, such fastener is a self-tapping threaded fastener. Further, one of the key lock and the key lock receptor may include an alignment feature 82 and then the other of the key lock and the key lock receptor includes a mating alignment feature.

The housing may extend beyond the pivot fastener parallel to the window frame and include an aperture for receiving a fastener for attaching the housing to the window. The aperture may include a retainer for receiving a fastener. The base of the aperture for receiving a fastener may include a cavity for receiving shavings formed by attaching the window latch to the window. The support wall may be between the aperture and cam latch, preferably, being substantially perpendicular to the window frame. The housing may extend beyond the pivot fastener parallel to the window frame to include a finger shoulder for providing access to the cam latch.

Also, the window latch may include a locking arm catch. Preferably, the locking arm includes a cam detent for engaging the locking arm. Further, the locking arm catch may include an aperture for receiving a fastener for attaching the locking arm catch to the window. Preferably, the aperture of the locking arm catch may include a retainer for receiving a fastener.

In a preferred embodiment, the pivot fastener is substantially non-compressible so as to facilitate the selective movement of the cam latch between the first open position and the second locked position.

Accordingly, one aspect of the present invention is to provide a locking window having a window frame including at least one window sash that is selectively movable between a first closed position and a second open position. A window latch is adapted to be attached to the window. The window latch is selectively movable between a first open position and a second locked position to secure the window sash in the closed position. The window latch includes a cam latch, a housing and a pivot fastener for attaching the cam latch to the housing.

Another aspect of the present invention is to provide a window latch for a locking window having a window frame including at least one window sash that is selectively movable between a first closed position and a second open position. The window latch includes a cam latch, a housing including a support wall, and a pivot fastener for attaching the cam latch to the housing. The cam latch is selectively movable between a first open position and a second locked position to secure the window sash in the closed position.

Still another aspect of the present invention is to provide a locking window having a window frame including at least one window sash that is selectively movable between a first closed position and a second open position and a window latch adapted to be attached to the window. The window latch is selectively movable between a first open position and a second locked position to secure the window sash in the closed position. The window latch includes a cam latch, a housing including a support wall, a pivot fastener for attaching the cam latch to the housing, and a detent for retaining the cam latch in one of the open and the locked positions.

These and other aspects of the present invention will become apparent to those skilled in the art after a reading of the following description of the preferred embodiment when considered with the drawings.

DESCRIPTION OF THE PREFERRED EMBODIMENTS

Figure 1:
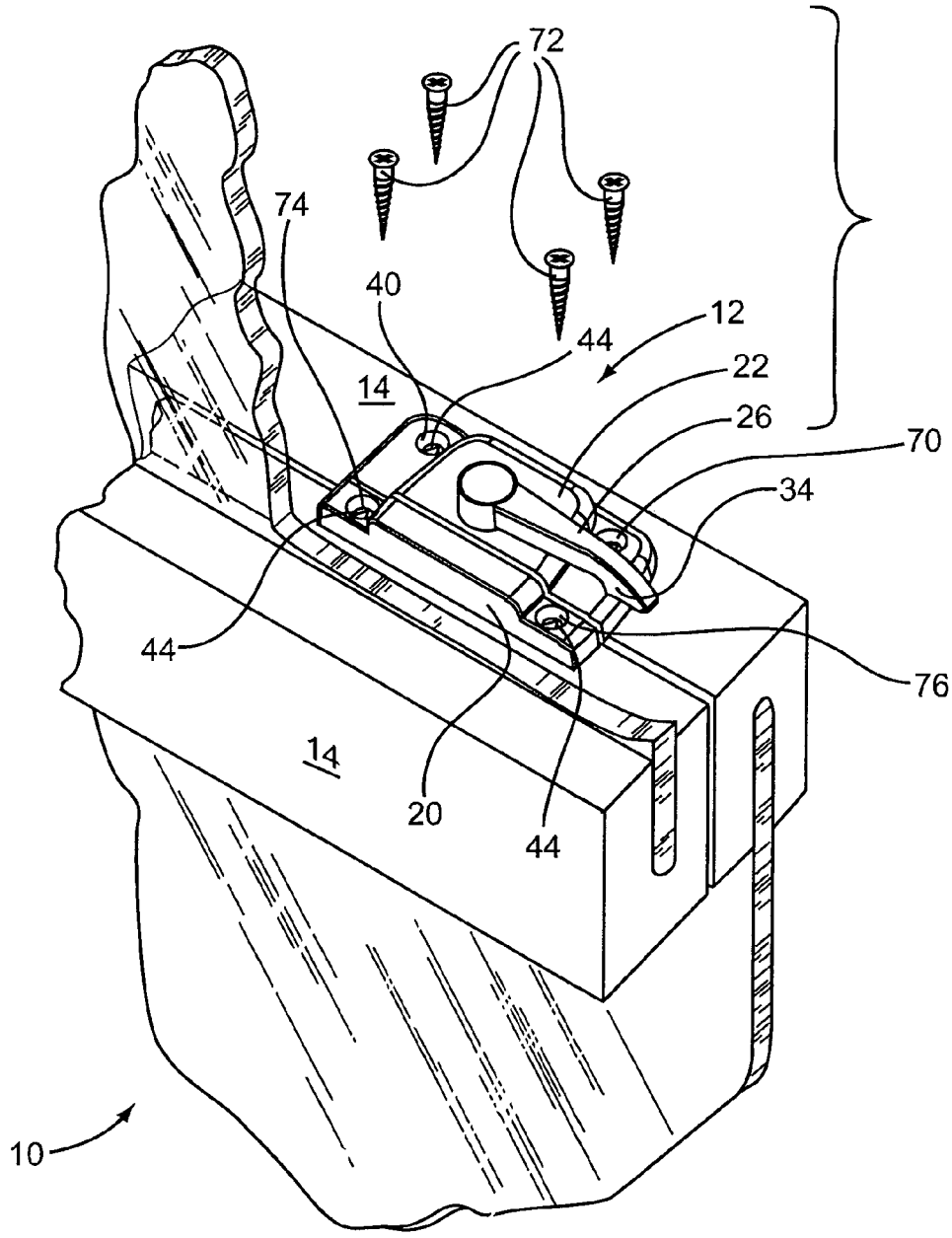
FIG. 1 is a perspective view of a locking window constructed according to the present intention.

In the following description, like reference characters designate like or corresponding parts throughout the several views. Also in the following description, it is to be understood that such terms as "forward," "rearward," "front," "back," "right," "left," "upwardly," "downwardly," and the like are words of convenience and are not to be construed as limiting terms.

Figure 2A:
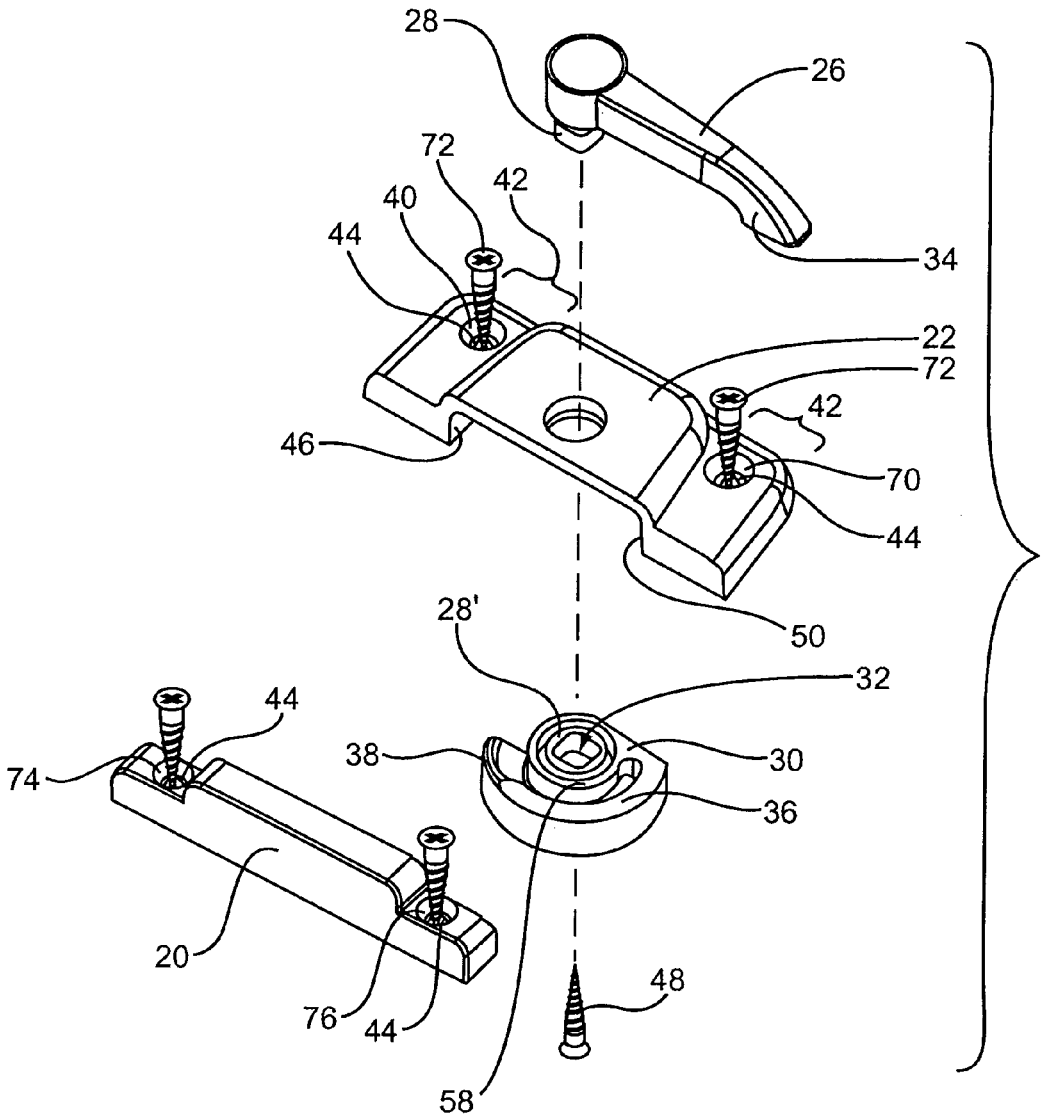
FIG. 2A is an isometric top exploded view of the window latch of the locking window shown in its closed position.
Figure 2B:
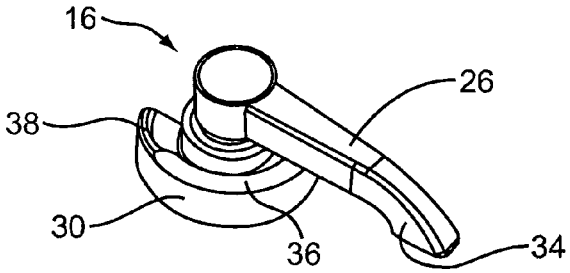
FIG. 2B is an isometric view of the assembled cam latch of the window latch of FIG. 2A.
Figure 3A:
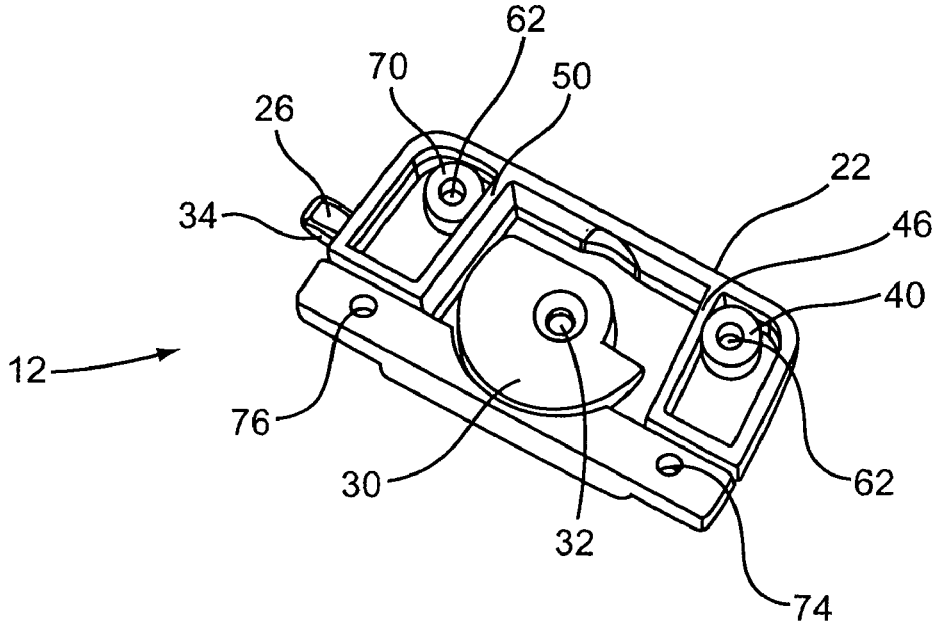
FIG. 3A is an isometric bottom view of the window latch of the locking window shown in its closed position.
Figure 3B:
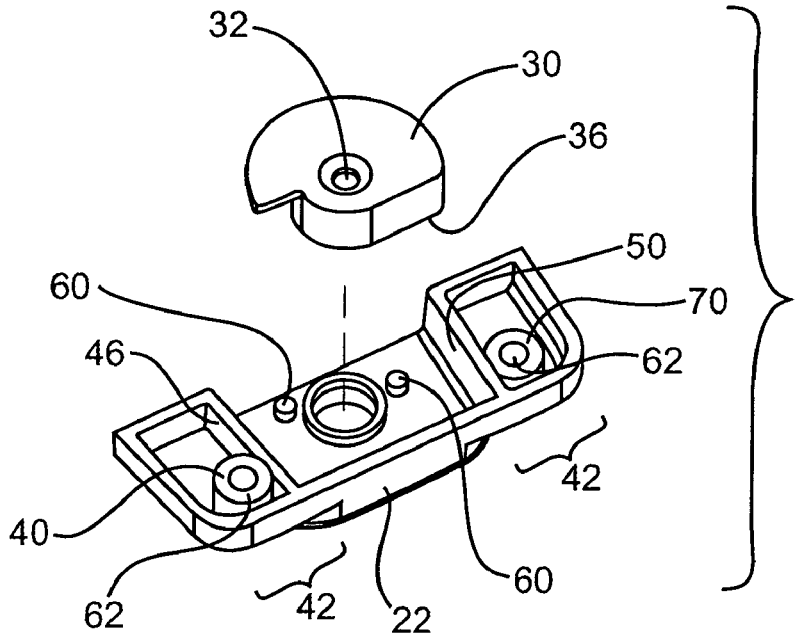
FIG. 3B is an isometric bottom exploded view of the housing and the cam latch of the window latch of the locking window shown in its closed position.

Referring now to the drawings in general and FIG. 1 in particular, it will be understood that the illustrations are for the purpose of describing a preferred embodiment of the invention and are not intended to limit the invention thereto. A perspective partial view of the locking window 10 is shown in FIG. 1. The window latch 12 includes a housing 22 fastened to one sash of the frame 14 and a locking arm catch 20 having a cam detent 21 fastened to another corresponding sash of the frame 14 and opposite to the housing 22. As seen in FIGS. 2A and 2B, a cam latch 16 includes an actuator arm 26 and locking arm 30 pivotally mounted through an aperture in the housing 22.

The window 10 is locked by pivotally moving the actuator arm 26 inward toward the housing 22, causing the locking arm 30 to pivotally move away from the housing 22 and engage the cam detent 21 of the locking arm catch 20. The locking arm 30 disengages the cam detent 21 of the locking arm catch 20 and unlocks the window 10 when the actuator arm 26 pivotally moves away from the housing.

As best seen in FIGS. 2A, 3A, 4A, and 4B, in the locked position, the locking arm 30 protrudes beyond the face of the housing 22. By extending into the locking arm catch 20 on the corresponding sash of the frame of the window 10, a cam wall 36 of the locking arm 30 engages the cam detent 21. At the same time, the actuator arm 26 is to one side of the housing 22 of the window latch 12 so as to be substantially aligned with the face of the housing 22. At the advance end of the cam wall 36, the locking arm 30 may include an incline 38, seen in FIGS. 2A, 2B, 4A, 4B, 5A, 5B and 6A, to better facilitate insertion of the locking arm 30 into the locking arm catch 20 to engage cam detent 21.

Figure 5A:
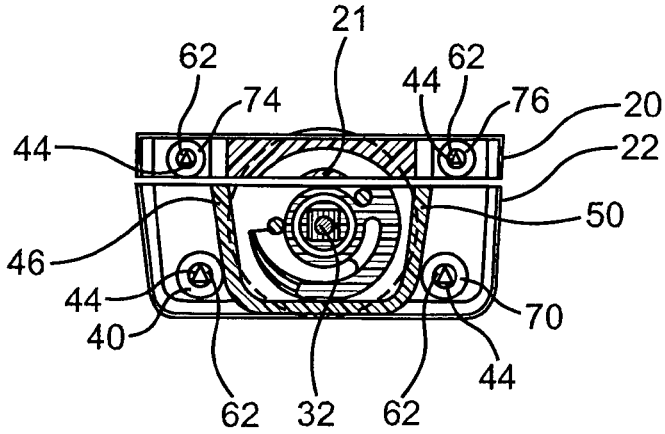
FIG. 5A is a top view through the same section as FIG. 4 of the window latch shown in its opened position.
Figure 5B:
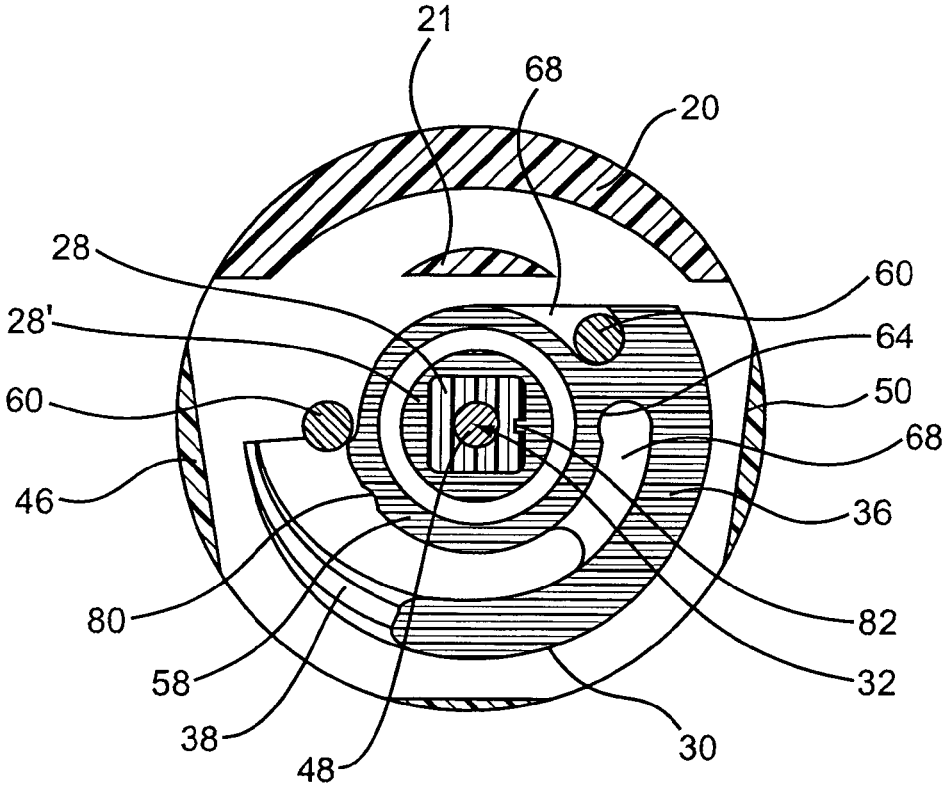
FIG. 5B is a magnified detail of a portion of the top view through section of FIG. 5A

As best seen FIGS. 5A and 5B, in the open position, the locking arm 30 is withdrawn from the locking arm catch 20 and concealed within the housing 22 of the window latch 12. At the same time, the actuator arm 26 of the cam latch 16 is at another side of the housing 22 of the window latch 12 so as to be substantially aligned with the face of the housing 22 at the other side of the window latch 12.

As previously mentioned, the cam latch 16 includes an actuator arm 26 and a locking arm 30. The cam latch 16 pivots about a pivot point 32. The housing 22 has an aperture at the pivot point 32 to accommodate a pivot fastener 28, 28'. The length of the actuator arm 26 is approximately twice the length of the locking arm 30, thereby providing a mechanical advantage in opening and locking the window 10.

As seen in FIGS. 3A, 3B, 4A, 5A, 6A and 6B, the housing 22 is strengthened by support walls 46, 50 located between an aperture 40 or 70 for attachment and the pivot point location 32.

Figure 6A:
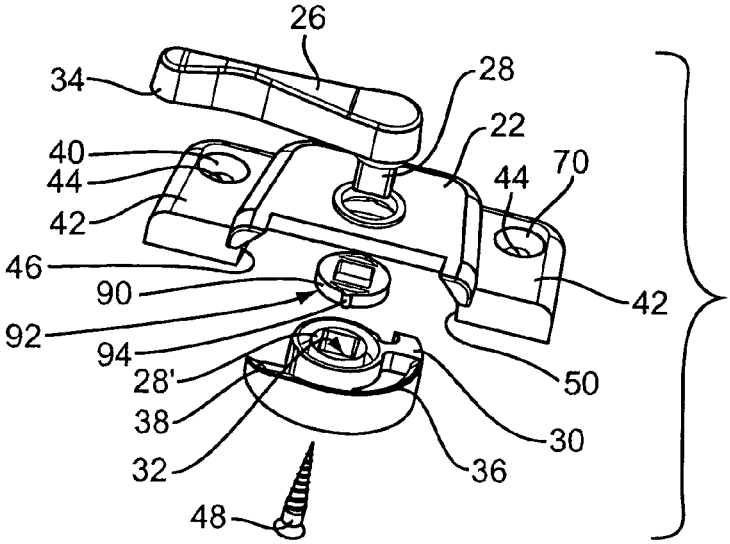
FIG. 6A is an exploded isometric top view of a window latch including a bushing.
Figure 6B:
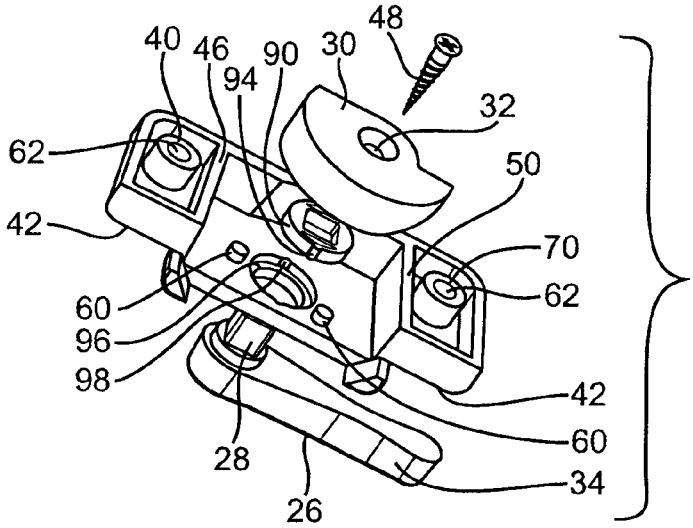
FIG. 6B is an exploded isometric bottom view of the window latch of FIG. 6A.

The pivot fastener 28, 28' is shown in FIGS. 2A and 6A in a top exploded view; in FIGS. 4 and 5 in through sectional views; and in FIG. 6B in a bottom exploded view of the window latch 12. The pivot fastener 28, 28' allows the cam latch 16 to pivot freely about the pivot point 32 while the window latch 12 is affixed to the window frame 14. The pivot fastener 28, 28' includes a male key lock portion 28 and a female key lock portion 28', both having a central aperture that allows a fastener 48 to pass therethrough. In the preferred embodiment, the fastener 48 may be any threaded fastener, such as a screw. The female key lock portion 28' is part of the locking arm 30 of the cam latch 16. It will be understood by those skilled in the art that the female key portion 28' may instead be part of the actuator arm 26 and the male portion 28 may be part of the locking arm 30. Further, each of the male key lock potion 28 and the female key portion 28' may include a complementary alignment feature 82 that facilitates the rapid assembly of pivot fastener 28, 28' so that actuator arm 26 and locking arm 30 align properly with the face of housing 22.

A housing 22 having at least a single aperture 40 partially encloses both the locking arm 30 of the cam latch 16 and pivot fastener 28, 28', protecting them from debris that may be generated during construction or installation of the window frame 14 or window 10. The aperture 40 serves as a first attachment point and, in the preferred embodiment, the housing 22 includes a second aperture 70 which serves as a second attachment point for the window latch 12.

Apertures 40 and 70 may each further include an internal retainer 44. An internal retainer 44 may be a small piece of plastic molded into the aperture 40 or aperture 70 that allows a fastener 72 to be temporarily secured in apertures 40 and 70 for packaging or shipping purposes and to prevent loss. Expediting the rapid assembly of window frames in a manufacturing environment is a further advantage of an internal retainer 44.

Each aperture 40 and 70 further may include a cavity 62 in its bottom surface to accommodate shavings generated when the window latch 12 is affixed to the window frame 14. Cavity 62 also may accommodate any pull-up of the window frame 14 during attachment of the window latch 12 to the window frame 14.

The window latch 12 may include structural features such as a detent 6 that limits the range of movement of the cam latch 16 relative to the housing 22. The limited of movement of the cam latch 16 may be accomplished through the cooperation of structural features of the housing 22 and the cam latch 16. Likewise these structural features may cooperate in manner that provide a user of the window latch 12 a feel or sound or both that allow the user to know whether the cam latch 16 is fully engaged or fully disengaged position. In this manner, a user may see, feel and hear that the window latch 12 fully engaged or fully disengaged position.

Figure 4A:
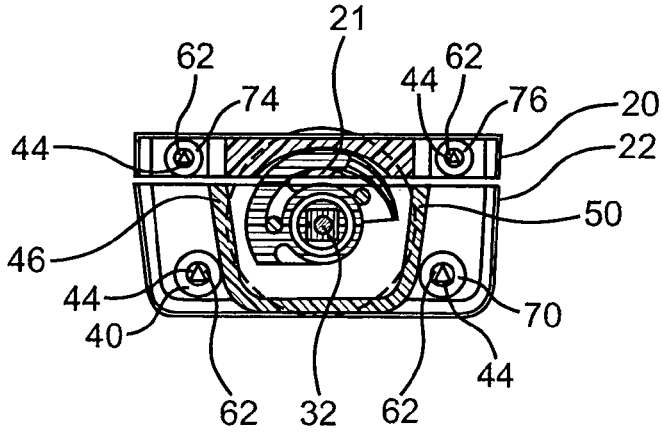
FIG. 4A is a top view through section of the window latch of FIGS. 1, 2A, and 3A, shown in its closed position.
Figure 4B:
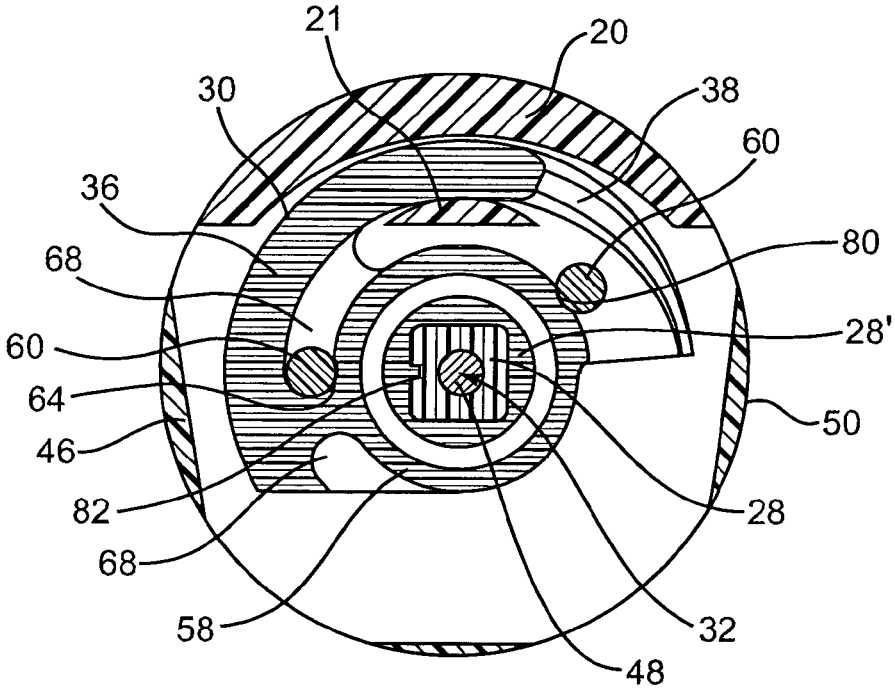
FIG. 4B is a magnified detail of a portion of the top view through section of FIG. 4A.

As may be best seen in FIGS. 3B, 4A, 4B 5A, 5B and 6B, the detent may be a protrusion 60 extending from the housing 22 that cooperates with a groove 68 defined by the cam wall 36 and collar 58 of the locking arm 30. FIGS. 4A, 4B 5A, and 5B are through sections of the window latch 12 just below the bottom of the upper most inner surface and above the top of the lower most outer surface of housing 22. As seen in FIGS. 3B, 4A, 4B 5A, 5B and 6B the housing may include a pair of protrusions 60. As seen in FIGS. 4A, 4B 5A, and 5B the locking arm 30 may include a pair of grooves 68. The longer of the grooves 68 has a slightly enlarged diameter 64 at blind end. The presence of the enlarged diameter 64, which may resemble a barbell shaped region, reduces a diameter of the collar 58 creating a recess for seating one protrusion 60 when the locking arm 30 is moved to the position for engaging the cam detent 21 as shown in FIGS. 4A and 4B. In this manner, a user window latch experiences the sensations of the one protrusion 60 seating in the recess at the blind end created by the enlarged diameter 64. In addition to seeing, the sensation may include the feel and audible snap of the cam latch 16 fully engaging. The shorter of the grooves 68 cooperates with the other of the protrusions 60 when the locking arm 30 is moved to the position for fully disengaging the window latch 21 as shown in FIGS. 5A and 5B.

Each protrusion 60 cooperates with a corresponding groove 68 and the collar 58. The protrusions 60 are located proximate to the pivot point 32 of the cam latch 16. In addition to the recess at the barbell shaped region 64 of the longer groove 68, the collar 58 includes regions having different diameters. As seen in FIGS. 4B and 5B, a smaller diameter region extends from the end of the shorter groove 68 to the start of the longer groove 68. Also as seen in FIGS. 4B and 5B, a larger diameter region extends from the transition from the smaller diameter region to the larger diameter region to the end of the longer groove 68. The transition from the smaller diameter region to the larger diameter region is opposite the barbell shaped region 64 of the longer groove 68. In addition, the collar 58 includes a grove 80 that is opposite to the end of the shorter groove 68. The pair of protrusions 60 mate with the grooves 68 and collar 58 of the locking arm 30.

In operation, as the cam latch 16 moves along its range of motion, protrusions 60 travel along the different diameter regions of collar 58, a portion of which may be within grooves 68. As seen in FIGS. 4A and 4B, when moving cam latch 16 to the fully engaged position, one protrusion 60 reaches the barbell shaped regions 64 while the other reaches groove 80. At this point, the one protrusion 60 enters a barbell shaped region 64 of groove 68, producing an audible snap. As seen in FIGS. 5A and 5B, when moving cam latch 16 to the fully disengaged position, one protrusion 60 reaches transition from the larger diameter region to the smaller diameter region of collar 58 while the other reaches the end of the shorter groove 68. At this point, the one protrusion 60 drops from the larger diameter region to the smaller diameter region of collar 58, producing an audible snap. The audible snap assists the user in determining whether the window latch 12 is in a fully engaged or fully disengaged position.

In addition to or in place of the structures discussed above, the window latch 12 further may include structural features such as a bushing 92 as a detent that limits the range of movement of the cam latch 16 relative to the housing 22.

Figure 6C:
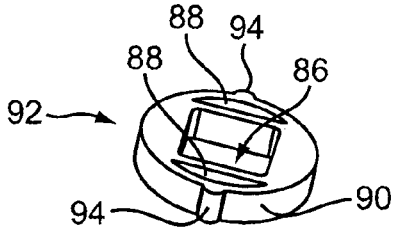
FIG. 6C is a magnified detail of the bushing of FIGS. 6A and 6B.

As may be best seen in FIGS. 6A, 6B and 6C, the detent may be a protrusion 94 extending from the bushing 92 that cooperates with a groove 98 in a recess 96 defined by the bottom surface of housing 22. The bushing 92 may include a resilient portion 90 that in the present example is created by using a gap 88 adjacent to protrusion 94. The resilient portion 90 acts to compress the bushing 92 to permit the movement of cam latch 16. The bushing 92 may include a pair of protrusions 94 and corresponding gaps 88. As seen in FIGS. 6A, and 6B the bushing 92 may fit on pivot fastener 28, 28' between the actuator arm 26 and the locking arm 30 and below housing 22 in recesses 96. Each protrusion 94 cooperates with a corresponding groove 98 and the housing 22. Bushing 92 is seated within recess 96 and protrusions 94 are initially aligned with corresponding grooves 98. The protrusions 94 may be located on the outer diameter of the bushing 92. It will be appreciated by those skilled in the art that the protrusion 94 and resilient region 90 may be included as part of the housing 22 and the groove 98 may be in the busing 92. Any other structural combinations that accomplish at least one of the see, feel, hear and combination thereof functions are part of the present invention.

In operation, as the cam latch 16 moves along its range of motion, protrusions 94 travel from grooves 98 and the wall of recess 96 compresses the resilient region 90 of bushing 92.

When moving cam latch 16 to the fully engaged position, the protrusions 94 reach their corresponding grooves 98. At this point, the resilient region 90 replaces the protrusions 94 to their original extended position so that while the protrusions 94 enter their corresponding grooves 68 an audible snap is produced. When moving cam latch 16 to the fully disengaged position, similar events occur. The audible snap assists the user in determining whether the window latch 12 is in a fully engaged or fully disengaged position.

As seen in FIGS. 4A, 4B, 5A and 5B, the locking arm catch 20 includes a cam detent 21 that the locking arm 30 engages. The locking arm catch 20 has at least one aperture 74. The aperture 74 serves as a first attachment point and, the locking arm catch 20 may include a second aperture 76 that serves as a second attachment point for the window latch 12.

Apertures 74 and 76 may each further include an internal retainer 44. A small piece of plastic molded into the aperture 74 or aperture 76 may act as an internal retainer 44 that allows a fastener 72 to be temporarily secured in apertures 74 and 76 for packaging or shipping purposes, and to prevent loss. Expediting the rapid assembly of window frames in a manufacturing environment is a further advantage of an internal retainer 44.

Each aperture 74 and 76 further may include a cavity 62 in its bottom surface to accommodate shavings generated when the locking arm catch 20 is affixed to the window frame 14. Cavity 62 also may accommodate any pull-up of the window frame 14 during attachment of the window latch 12 to the window frame 14.

The window latch 12 may be formed from any lightweight durable material, such as a lightweight metal including aluminum, or a polymeric material. Applicants contemplate that suitable materials may be characterized by at least one of high strength, high rigidity, very good impact resistance, good elastic properties, dimensional stability, low tendency to creep, and simple processing. Preferably, suitable materials may be characterized by a plurality of the above. Applicants have found that among polymeric materials, polyamides (also known as nylons) to work well and, in particular, that polyamides including a filler may work well. In the preferred embodiment, the material used to form the window latch 12 was made using commercially available polyamides such as the "ULTRAMID®" polyamide sold by BASF Corporation of Mount Olive, N.J. These ULTRAMID®" polyamide materials, their applications, properties and processing as described in a publication by BASF Plastics entitled "ULTRAMID®" Polyamides, the subject mater of which is incorporated in its entirety herein by reference.

Applicants contemplate that a semi-crystalline Nylon 6 (PA6) containing about 30 percent glass fiber may be preferred. One such material is manufactured by Hughes Supply & Manufacturing Company of Thomasville, Inc. of Thomasville, N.C. under the trademark "FIBERTRON™" material and has the properties presented below in Table 1.

TABLE 1

FIBERTRON ™ MATERIAL
Description: Semi-crystalline Nylon 6 (PA6)
Filler System: 33% Glass Fiber
Characteristics: Near Prime

| PROPERTY | UNITS | TYPICAL VALUES | STANDARD |
|---|---|---|---|
| | General | | |
| Density | g/cm3 | 1.42 | ASTM D792 |

TABLE 1-continued

FIBERTRON ™ MATERIAL
Description: Semi-crystalline Nylon 6 (PA6)
Filler System: 33% Glass Fiber
Characteristics: Near Prime

| PROPERTY | UNITS | TYPICAL VALUES | STANDARD |
|---|---|---|---|
| Melt Flow Index | g/10 min. | — | ASTM D1238 |
| Water Absorption | % | — | ASTM D570 |
| Mold Shrinkage | in/in | 0.002-0.004 | ASTM D955 |
| | Mechanical | | |
| Tensile Strength (break) | psi | 19,500 | ASTM D638 |
| Elongation (break) | % | 3.2 | ASTM D638 |
| Flexural Strength (yield) | psi | 29,750 | ASTM D790 |
| Flexural Modulus | psi | 1,250,000 | ASTM D790 |
| Impact Strength (Izod-notched) | ft-lb/in | 3.3 | ASTM D256 |
| | Thermal | | |
| Heat Deflection Temperature (264 psi) | F | — | ASTM D648 |
| Vicat Softening Temperature | F | — | ASTM D1525 |
| | Flammability | | |
| UL Flammability Rating | Class | — | UL 94 |

The "FIBERTRON™" material may be made using commercially available polyamides such as the "ULTRAMID®" polyamide sold by BASF Corporation of Mount Olive, N.J. These ULTRAMID®" polyamide materials, their applications, properties and processing as described in a publication by BASF Plastics entitled "ULTRAMID®" Polyamides, the subject mater of which is incorporated in its entirety herein by reference.

Applicants contemplate that alternative materials may appropriate for bushing 92. As with the remainder of the window latch 12, suitable materials for bushing 92 may be characterized by at least one of high strength, high rigidity, very good impact resistance, good elastic properties, dimensional stability, low tendency to creep, and simple processing. Further, suitable materials for bushing 92 may be characterized by at least one of compatible with the materials used for the remainder of window latch 12, wear resistance, non-abrasive, and a capability of providing the elastic properties for resilient region 90. To that end, bushing 92 may be formed from any lightweight durable material, such as a lightweight metal including aluminum, or a polymeric material. Applicants have found that among polymeric materials, polyoxymethylene (also known as POM, polymethyleneoxide, PMO, polyformaldehyde, polyacetal, acetals, acetal resin, and simple acetal) to work well. Polyoxymethylene including a filler may work well. In the preferred embodiment, the material used to form the bushing 92 are made using commercially available polyoxymethylenes such as the "DELRIN®" acetal resin sold by E.I. du Pont de Nemours and Company of Wilmington, Del. These "DELRIN®" acetal resin materials, their applications, properties and processing as described in a publications by E.I. du Pont de Nemours and Company entitled "DELRIN®" acetal resin: Low wear low friction; "DELRIN®" acetal resin: Design Guide-Module III; "DELRIN®" acetal resin: Molding Guide; and "DuPont®" DuPont Engineering Polymers: Products and Properties Guide-"DELRIN®" acetal resin, "DELRIN®" P performance acetal resin, "DELRIN®" "ELEVEN Series" acetal resin, the subject mater of each is incorporated herein by reference in its entirety.

As may be appreciated by those skilled in the art, a window and window latch 12 constructed according to the present invention may be substantially completely formed from plastics while at the same time still provide sufficient strength due to their arrangement to resist normal wear and tear during assembly and use.

Certain modifications and improvements will occur to those skilled in the art upon a reading of the foregoing description. It should be understood that all such modifications and improvements have been deleted herein for the sake of conciseness and readability but are properly within the scope of the following claims.

We claim:

1. A window latch for a locking window, said window having a window frame including at least one window sash which is selectively movable between a first closed position and a second open position, said window latch comprising:

(a) a cam latch selectively movable between a first open position and a second locked position to secure the window sash in said closed position;

(b) a housing including an opening for said cam latch, a perimeter wall having opposing ends defining said opening on one side of said housing, and a pair of rigid interior support walls, each partially defining said opening and extending across said housing from one opposing end of said perimeter wall to said perimeter wall on an opposite side of the housing wherein said perimeter wall having an opening for said cam latch and said pair of rigid interior support walls extend downward to engage the surface of the window sash to provide support for said housing;

(c) a pivot fastener for attaching said cam latch to said housing;

(d) a bushing adapted for use with said pivot fastener; and (e) a detent for retaining said cam latch in one of said open and said locked positions, wherein said detent includes at least one protrusion on one of said housing and said cam latch and a receiving groove on the other of said housing and said cam latch, said receiving groove for receiving said protrusion, said protrusion and said groove being substantially parallel to the axis of said pivot fastener.

2. The apparatus according to claim 1, wherein said cam latch includes an actuator arm, a locking arm and a pivot point location between said actuator arm and said locking arm.

3. The apparatus according to claim 2, further including a finger tab on said actuator arm.

4. The apparatus according to claim 2, said locking arm further including a cam wall.

5. The apparatus according to claim 2, wherein the ratio of the length of said actuator arm to the length of said locking arm is greater than about 2 to provide a mechanical advantage when said window latch is operated.

6. The apparatus according to claim 2, wherein one of said actuator arm and said locking arm includes a key lock receptor and the other of said actuator arm and said locking arm including a complementary key lock extending into said key lock receptor for attaching said cam latch to said housing.

7. The apparatus according to claim 6, further including a fastener extending into said key lock and key lock receptor.

8. The apparatus according to claim 7, said fastener is a self-tapping threaded fastener.

9. The apparatus according to claim 6, one of said key lock and said key lock receptor further including an alignment feature and the other of said key lock and said key lock receptor further including a mating alignment feature.

10. The apparatus according to claim 1, wherein said housing extends beyond said pivot fastener parallel to said window frame and includes an aperture for receiving a fastener for attaching said housing to said window.

11. The apparatus according to claim 10, wherein said aperture for receiving a fastener for attaching said housing to said window includes a retainer for receiving a fastener.

12. The apparatus according to claim 10, wherein the base of said aperture for receiving a fastener includes a cavity for receiving shavings formed by attaching said window latch to said window.

13. The apparatus according to claim 1, wherein said housing extends beyond said pivot fastener parallel to said window frame to include a finger shoulder for providing access to said cam latch.

14. The apparatus according to claim 13, wherein said support wall is between said aperture and cam latch.

15. The apparatus according to claim 14, wherein said support wall is substantially perpendicular to said window frame.

16. The apparatus according to claim 1, further including a locking arm catch.

17. The apparatus according to claim 16, further including a cam detent for engaging said locking arm.

18. The apparatus according to claim 16, further including an aperture for receiving a fastener for attaching said locking arm catch to said window.

19. The apparatus according to claim 18, wherein said aperture for receiving a fastener for attaching said locking arm catch to said window includes a retainer for receiving a fastener.

20. The apparatus according to claim 1, wherein said pivot fastener is substantially non-compressible so as to facilitate the selective movement of said cam latch between said first open position and said second locked position.

21. A locking window, said window comprising:

(a) a window frame including at least one window sash which is selectively movable between a first closed position and a second open position; and (b) a window latch adapted to be attached to said window and that is selectively movable between a first open position and a second locked position to secure said window sash in said closed position, said window latch comprising:

(i) a cam latch selectively movable between a first open position and a second locked position to secure the window sash in said closed position;

(ii) a housing including an opening for said cam latch, a perimeter wall having opposing ends defining said opening on one side of said housing, and a pair of interior rigid support walls, each partially defining said opening and extending across said housing from one opposing end of said perimeter wall to said perimeter wall on an opposite side of the housing wherein said perimeter wall having an opening for said cam latch and said pair of rigid interior support walls extend downward to engage the surface of the window sash to provide support for the housing;

(iii) a pivot fastener for attaching said cam latch to said housing;

(iv) a bushing between said cam latch and said housing; and (v) a detent for retaining said cam latch in one of said open and said locked positions, wherein said detent includes at least one protrusion on one of said housing and said cam latch and a receiving groove on the other of said housing and said cam latch, said receiving groove for receiving said protrusion, said protrusion and said groove being substantially parallel to the axis of said pivot fastener.

22. The apparatus according to claim 21, wherein said detent provides an audible indication of said cam latch being in one of said open and said locked positions.

23. The apparatus according to claim 21, wherein said detent includes at least one protrusion on one of said housing and said cam latch and a receiving groove on the other of said housing and said cam latch, said protrusion and said groove being substantially parallel to the axis of said pivot fastener.

24. The apparatus according to claim 21, wherein said detent includes at least one protrusion on one of said housing and said cam latch and a semi-circular receiving groove on the other of said housing and said cam latch, said semi-circular receiving groove including at least one barbell shaped portion for receiving said protrusion, said protrusion being substantially parallel to the axis of said pivot fastener and said groove being substantially perpendicular to the axis of said pivot fastener.

25. The apparatus according to claim 21, wherein said detent includes at least one resilient portion on one of said housing and said bushing, said resilient portion for accommodating said protrusion when said cam latch is moved from one of said open and said locked positions to the other of said open and said locked positions.

26. The apparatus according to claim 21, wherein said cam latch includes an actuator arm, a locking arm and a pivot point location between said actuator arm and said locking arm.

27. The apparatus according to claim 26, further including a finger tab on said actuator arm.

28. The apparatus according to claim 26, said locking arm further including a cam wall.

29. The apparatus according to claim 26, wherein the ratio of the length of said actuator arm to the length of said locking arm is greater than about 2 to provide a mechanical advantage when said window latch is operated.

30. The apparatus according to claim 26, wherein one of said actuator arm and said locking arm includes a key lock receptor and the other of said actuator arm and said locking arm includes a complementary key lock extending into said key lock receptor for attaching said cam latch to said housing.

31. The apparatus according to claim 30, further including a fastener extending into said key lock and key lock receptor.

32. The apparatus according to claim 31, said fastener is a self-tapping threaded fastener.

33. The apparatus according to claim 30, one of said key lock and said key lock receptor further including an alignment feature and the other of said key lock and said key lock receptor further including a mating alignment feature.

34. The apparatus according to claim 21, wherein said housing extends beyond said pivot fastener parallel to said window frame and includes an aperture for receiving a fastener for attaching said housing to said window.

35. The apparatus according to claim 34, wherein said aperture for receiving a fastener for attaching said housing to said window includes a retainer for receiving a fastener.

36. The apparatus according to claim 34, wherein the base of said aperture for receiving a fastener includes a cavity for receiving shavings formed by attaching said window latch to said window.

37. The apparatus according to claim 21, wherein said housing extends beyond said pivot fastener parallel to said window frame to include a finger shoulder for providing access to said cam latch.

38. The apparatus according to claim 37, wherein said support wall is between said aperture and cam latch.

39. The apparatus according to claim 38, wherein said support wall is substantially perpendicular to said window frame.

40. The apparatus according to claim 21, further including a locking arm catch.

41. The apparatus according to claim 40, further including a cam detent for engaging said locking arm.

42. The apparatus according to claim 40, further including an aperture for receiving a fastener for attaching said locking arm catch to said window.

43. The apparatus according to claim 42, wherein said aperture for receiving a fastener for attaching said locking arm catch to said window includes a retainer for receiving a fastener.

44. The apparatus according to claim 21, wherein said pivot fastener is substantially non-compressible so as to facilitate the selective movement of said cam latch between said first open position and said second locked position.

* * * * *

UNITED STATES PATENT AND TRADEMARK OFFICE

CERTIFICATE OF CORRECTION

PATENT NO. : 7,665,775 B1
APPLICATION NO. : 10/634118
DATED : February 23, 2010
INVENTOR(S) : D. Keith Miller et al.

It is certified that error appears in the above-identified patent and that said Letters Patent is hereby corrected as shown below:

In Column 5, Line 39, the "6" should be deleted

In Column 6, Line 4, the "21" should be "12"

Signed and Sealed this

Twelfth Day of October, 2010

David J. Kappos

David J. Kappos
*Director of the United States Patent and Trademark Office*